US006579080B1

(12) United States Patent
Spinnler

(10) Patent No.: US 6,579,080 B1
(45) Date of Patent: Jun. 17, 2003

(54) DISPLACEMENT MACHINE BASED ON THE SPIRAL PRINCIPLE

(75) Inventor: Fritz Spinnler, Mellingen (CH)

(73) Assignee: CRT Common Rail Technologies AG, Neuhausen (CH)

( * ) Notice: Subject to any disclaimer, the term of this patent is extended or adjusted under 35 U.S.C. 154(b) by 0 days.

(21) Appl. No.: 09/762,108

(22) PCT Filed: Feb. 10, 2000

(86) PCT No.: PCT/CH00/00077

§ 371 (c)(1),
(2), (4) Date: Feb. 2, 2001

(87) PCT Pub. No.: WO00/49275

PCT Pub. Date: Aug. 24, 2000

(30) Foreign Application Priority Data

Feb. 18, 1999 (CH) ..... 0313/99

(51) Int. Cl.[7] ..... F01C 1/04; F01C 11/00; F01C 21/04; F01C 21/06

(52) U.S. Cl. ..... 418/55.2; 418/55.3; 418/55.6; 418/60; 418/101

(58) Field of Search ..... 418/55.2, 55.3, 418/60, 55.6, 101

(56) References Cited

U.S. PATENT DOCUMENTS

| | | | | |
|---|---|---|---|---|
| 4,677,949 A | | 7/1987 | Youtie | 418/60 |
| 4,715,797 A | * | 12/1987 | Guttinger | 418/55.2 |
| 5,094,205 A | | 3/1992 | Billheimer | 418/60 |

FOREIGN PATENT DOCUMENTS

| | | | | |
|---|---|---|---|---|
| DE | 26 03 462 A1 | | 8/1976 | |
| DE | 35 14 230 A1 | | 10/1986 | |
| DE | 3826640 | * | 3/1989 | |
| EP | 0376026 | * | 7/1990 | 418/55.3 |
| EP | 0 846 843 A1 | | 6/1998 | |
| GB | 220296 | * | 1/1925 | 418/55.3 |
| JP | 59-15690 | * | 1/1984 | 418/60 |
| JP | 1-273891 | * | 11/1989 | 418/55.2 |

* cited by examiner

*Primary Examiner*—John J. Vrablik
(74) *Attorney, Agent, or Firm*—Oliff & Berridge, PLC

(57) ABSTRACT

A displacement machine for compressible media has two spiral feed chambers (11*a*, 11*b*) which are arranged opposite each other in a fixed housing (7*a*, 7*b*). Spiral displacement bodies (2–4) engage in these feed chambers. Said displacement bodies essentially consist of a disk (2) and spiral strips (3*a*, 3*b*) which are attached to each side of the disk. The strips are held in an eccentric manner in relation to the housing, so that during operation each point on the displacement body executes a circular or elliptical movement, depending on the configuration of the guiding device (49), said movement being limited by the cylinder walls of the feed chamber. One feed chamber (11*a*) is configured for compressing the working substance and the other feed chamber (11*b*) for expanding said working substance. The feed chambers and the strips (3*a*, 3*b*) which engage in said chambers consist of successive circular arc segments. The radii of the circular arc segments in the compression-side feed chambers (11*a*) decrease in size, when viewed in a direction of rotation. The radii of the circular arc segments in the expansion-side feed chambers (11*b*) increase in size, when viewed in the same direction of rotation.

14 Claims, 8 Drawing Sheets

DISPLACEMENT MACHINE BASED ON THE SPIRAL PRINCIPLE

BACKGROUND OF THE INVENTION

The invention relates to a displacement machine for compressible media with two spiral feed chambers which are arranged opposite each other in a fixed housing, and with spiral displacement bodies engaging in these feed chambers, consisting essentially of a central disk and of spiral strips which are attached to each side of the disk and which are held in an eccentric manner in relation to the housing, so that during operation each point on the displacement body executes a circular or elliptical movement, depending on the configuration of the guiding device, said movement being limited by the cylinder walls of the feed chamber, and so that the curvature of the strips is dimensioned such that they almost touch the inner cylinder walls and the outer cylinder walls of the feed chamber on in each case at least one sealing line per strip, said sealing line advancing continuously during operation, and, in order to guide the displacement body in relation to the housing, an eccentric arrangement is provided which essentially consists of a drive shaft and of an eccentric disk arranged thereon.

DESCRIPTION OF THE PRIOR ART

Displacement machines of the spiral structure variety are known for example from DE-C-26 03 462. Machines of this type of structure are used chiefly as compressors for gaseous media. During machine operation, a plurality of approximately sickle-shaped working chambers are enclosed along a displacement chamber between the spiral-shaped displacement body and the two cylinder walls, which working chambers move through the displacement chamber from an inlet to an outlet, their volume continuously decreasing and the pressure of the working substance correspondingly increasing.

A machine of the abovementioned type, in which the spirals encompass a total angle of wrap of 360° or more, is known from DE 35 14230 A1. In such a machine, the spiral strips are arranged axially projecting from both sides of a disk which has a hub for supporting the eccentric crank mechanism. Moreover, the arrangement of the spiral strips is such that, during the rotating movement of the disk, the working chambers created on both sides of the disk decrease in volume and compression of the working substance takes place. In general, the strips are arranged symmetrically with respect to the disk.

For working processes which are intended to be carried out at a higher pressure than the surrounding pressure and in which only a slight pressure loss occurs in the process itself, expansion machines are also used in addition to the compression machines for the purpose of exploiting the residual pressure difference, and this improves the overall degree of efficiency of the machines. Working processes which preferably operate at a higher pressure than the surrounding atmospheric pressure, and in which a relatively small drop in pressure occurs in the process, are, for example, fuel cell processes. Such processes are run using commercially available compression and expansion machines in order to maintain the high degree of efficiency of the oxidation of hydrogen in the fuel cell.

SUMMARY OF THE INVENTION

It is an object of the invention to configure a machine of the type mentioned at the outset in such a way that the working medium can be both compressed and expanded using just one displacement body revolving in a housing.

According to the invention, this object is achieved by the fact that one feed chamber is configured for compressing the working substance and the other opposite feed chamber for expanding said working substance, the feed chambers and the strips engaging in them consisting essentially of successive circular arc segments, the radii of the circular segments in the compression-side feed chambers and strips essentially decreasing in size, when viewed in a direction of rotation, and the radii of the circular arc segments in the expansion-side feed chambers and strips essentially increasing in size, when viewed in the same direction of rotation.

The spiral strips attached to both sides of the central disk of the displacement body are accordingly designed such that, in the displacement movement of the displacement body advancing during machine operation, the volume of the working chamber enclosed by these strips and by the associated feed chamber decreases on one side of the disk. On the other side of the disk, the volume of the working chamber enclosed by these strips and by the associated feed chamber increases. Compared with the solutions known from the prior art, the spiral strips attached to both sides of the central disk of the displacement body are in this case arranged asymmetrically in relation to each other.

The advantage of the invention is, among other things, that a very simple and therefore cost-effective construction of the machine can be achieved, since both the compression and the expansion take place using just one movable displacement element.

The compression-side feed chamber in general extends from a radially outward low-pressure inlet to a radially inward high-pressure outlet. If the expansion-side feed chamber now extends from a radially inward high-pressure chamber to a radially outward low-pressure outlet, the working substance on the compression side, when viewed in the radial direction, is fed counter to the direction of the working substance on the expansion side. This has the advantage that the stresses on the central disk and on the spiral strips caused by the gas pressures are approximately symmetrical on compression side and expansion side.

If, by contrast, the expansion-side feed chamber likewise extends from a radially outward inlet to a radially inward low-pressure chamber, the working substance on the compression side, when viewed in the radial direction, is fed in the same direction as the working substance on the expansion side. As a result, the inner ends (when viewed in the radial direction) of the spiral strips on the expansion side come to lie approximately opposite the inner ends (likewise viewed in the radial direction) of the compression-side spiral strips in relation to the central disk. The attachment of the inner ends of the spiral strips to the central disk is subjected to high stresses during machine operation and is more or less hot depending on the pressure ratio on the compression side. This arrangement has the advantage that, when such a machine is used at a high compression pressure ratio, heat can be conveyed from the inner hot end of the compression-side strip through the central disk to the cold inner end of the expansion-side strip. This arrangement is of importance when a good heat-conducting light metal is used to produce the displacement body. Use of such light materials results in a relatively low centrifugal force of the displacement component during machine operation.

If the hub of the disk is surrounded by a high-pressure chamber on the compression side, the hub interior is expediently closed off in an airtight manner from this high-pressure chamber by means of a closure piece. By this means, a counterweight, provided to compensate the eccentric movement of the eccentric disk and of the displacement body, can be arranged on the drive shaft advantageously in the expansion-side pressure chamber surrounding the hub. The advantage of such an arrangement is the absolute separation of the lubricant oil from the compressed air.

If the rotor of an electric motor driving the displacement body is arranged on a common drive shaft with the eccentric disk and the displacement body, it is expedient that an intermediate housing is attached to the housing of the electric motor, on that side of the electric motor facing away from the displacement body, into which intermediate housing protrudes the drive shaft provided with a lubricant feed device, and if a housing for a lubricant reservoir is secured on the intermediate housing. Such an arrangement with an intermediate housing is advantageous for receiving, for example, a combined reducing and synchronizing gear system which protrudes into the oil reservoir and is thus lubricated.

If the displacement component is guided in a known manner by a separate second eccentric arrangement, the two eccentric shafts are provided with gearwheels of identical size. These are driven and synchronized by a third gearwheel. The third gearwheel is preferably smaller and sits on the shaft of the drive motor. The latter is designed as a small rapidly rotating electric motor. The weight of the overall compressor/expander unit is thus lower compared with the use of an electric motor rotating at the same speed as the compressor/expander.

It is suitable for the wall of the expansion-side half of the housing to be configured in the area of the outlet in such a way that a container for receiving lubricant is formed together with the outer end of the cylinder wall of the expansion-side feed chamber, said container being connected to the lubricant circuit via external lines. Since the gases leaving the expander have a low temperature, this arrangement of the lubricant oil container at the outer end of the cylinder wall allows the lubricant to cool during machine operation.

BRIEF DESCRIPTION OF THE DRAWINGS

A number of illustrative embodiments of the invention are represented in the drawing. Only the elements essential to an understanding of the invention are shown. The direction of flow of the various working substances is indicated by arrows. Elements having the same functions are labeled with the same reference numbers in the different figures.

DESCRIPTION OF THE PREFERRED EMBODIMENTS

Figures 1, 2:
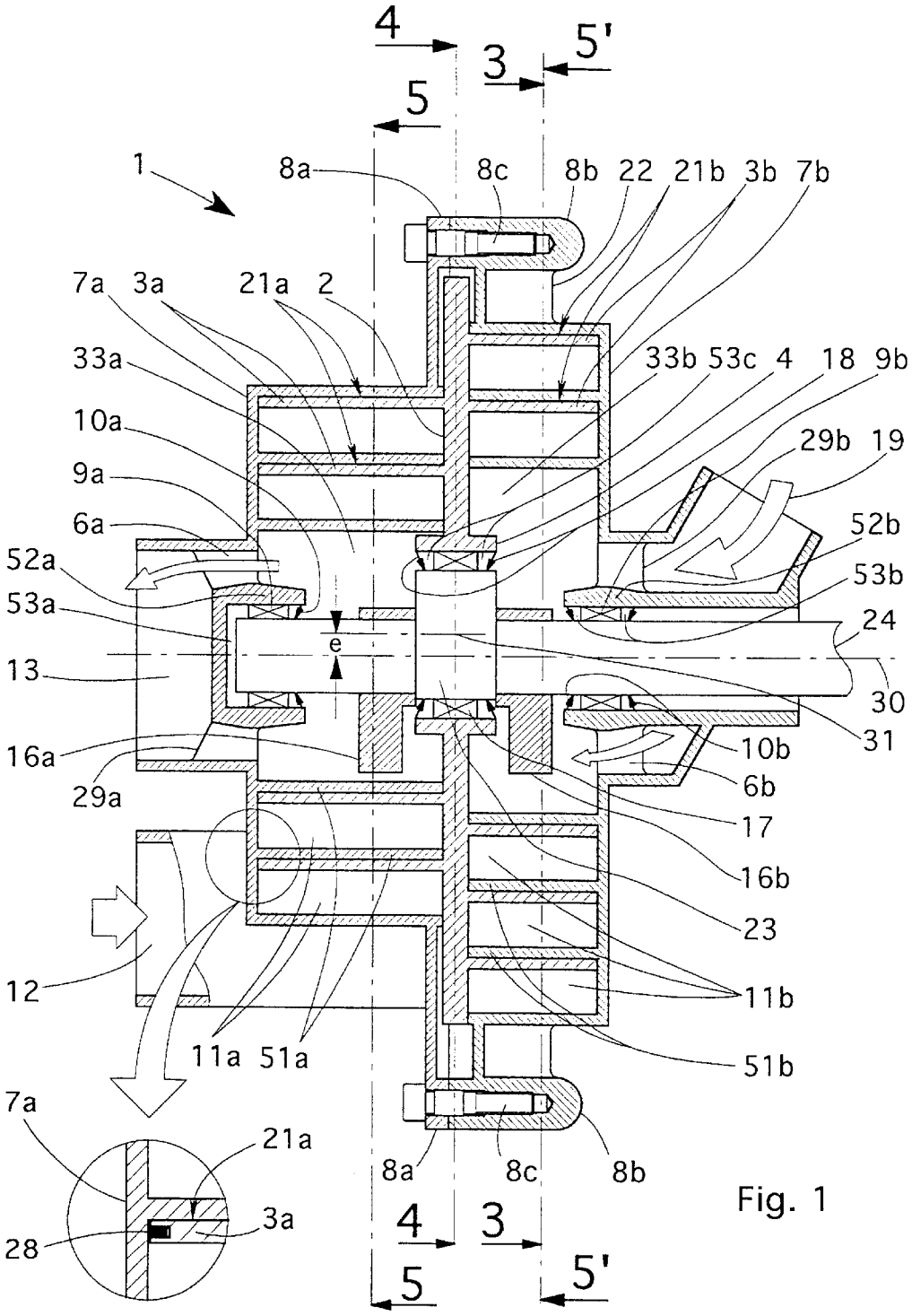
FIG. 1 shows a longitudinal section through the displacement machine.
FIG. 2 shows a partial section from FIG. 1, in an enlarged representation, with the sealing of the strips on the bottom of the sickle-shaped working chambers.
Figure 6:
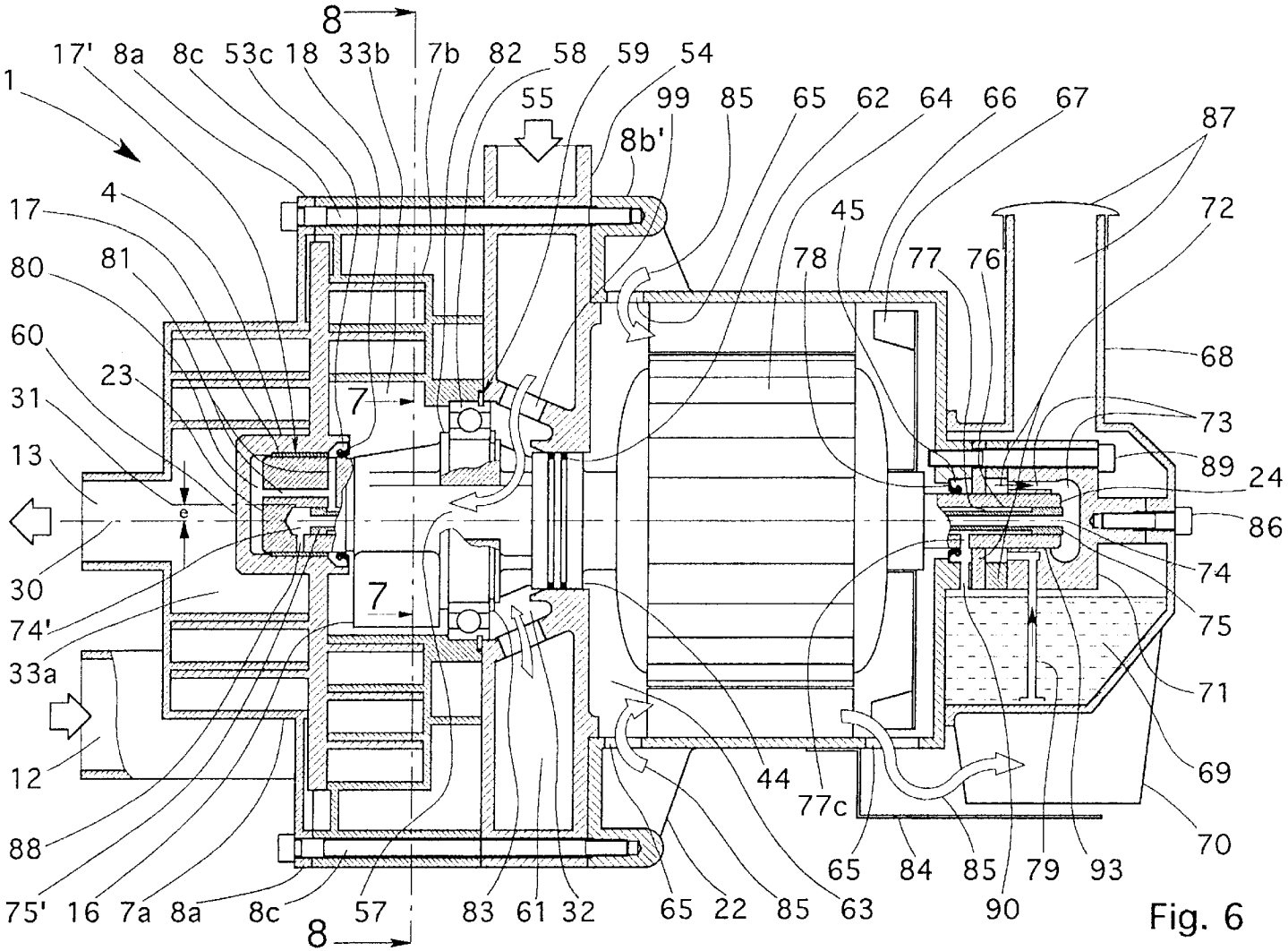
FIG. 6 shows a longitudinal section through an alternative embodiment of the displacement machine with drive motor and circuit for lubricant and coolant.

For the purpose of explaining the manner of functioning of the displacement machine, reference is made to DE-C3-26 03 462 already mentioned above. There follows a brief description only of those elements of the machine construction and process which are necessary for understanding the invention:

The compressor/expander machine as a whole is designated by 1 in FIGS. 1 and 6. In the references, the "a" suffixes are used for the compression side, while the "b" suffixes are used for the expansion side of 1.

Figure 4:
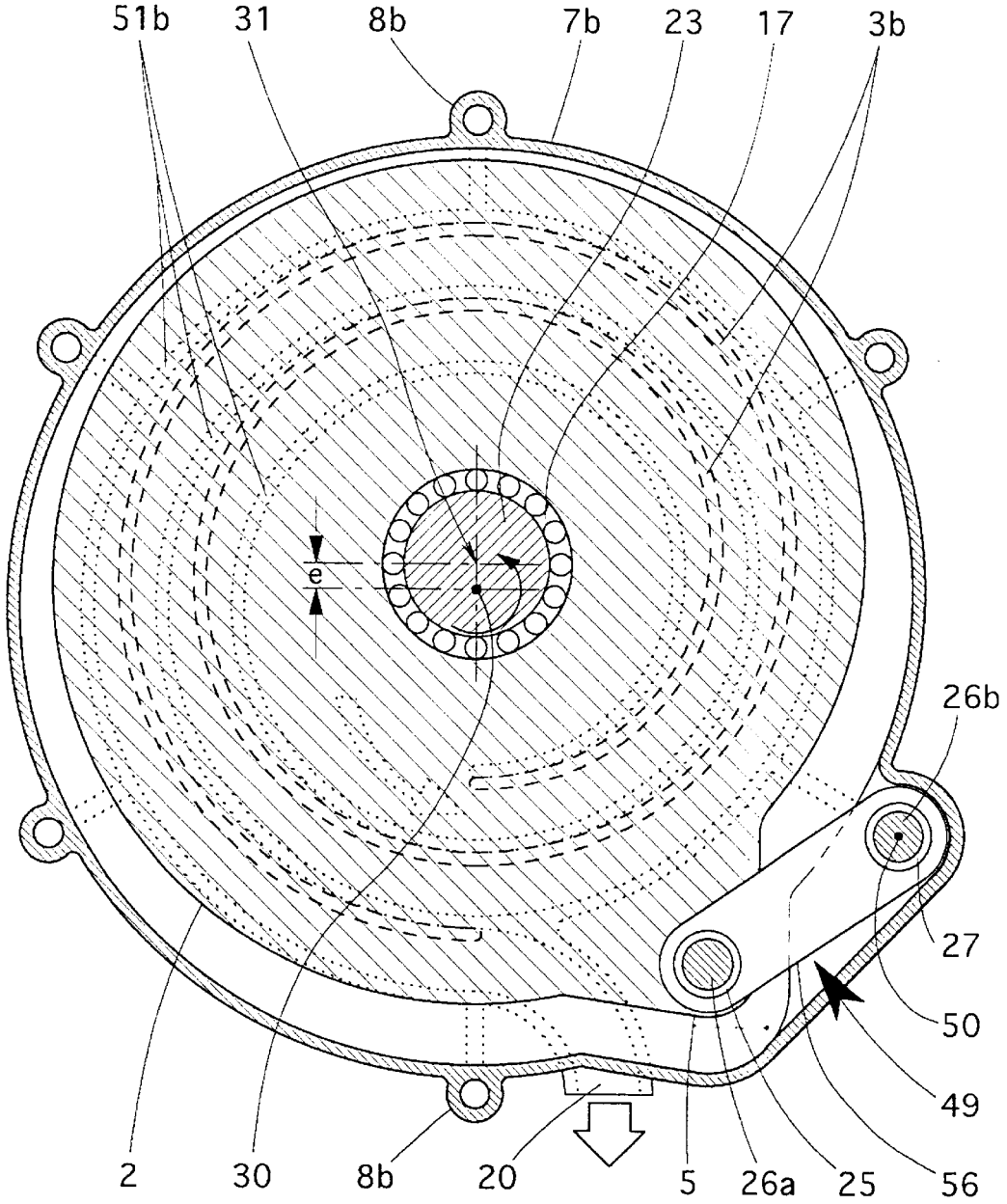
FIG. 4 shows a section through the disk of the armature of the displacement machine according to line 4—4 in FIG. 1.

A spirally extending displacement body is arranged on each side of the disk 2. Said body comprises strips 3*a*, 3*b* which are held vertically on the disk 2. In the example shown, the spiral itself is made up of a plurality of contiguous circular arcs. Reference number 4 designates a hub with which the disk 2 is mounted on an eccentric bearing 17. FIGS. 1, 4 and 6 show the bearing 17 which sits on an eccentric disk 23 which in turn constitutes part of a drive shaft 24. In FIG. 4, reference number 5 designates an eye which is arranged radially outside the strips 3*a*, 3*b* and receives a guide bearing 25 which is mounted on a bolt 26*a*. The latter in turn constitutes part of a guiding device 49 which consists for example of an oscillating link 56, one end of which is mounted in the housing 7*a*, 7*b* by means of bolt 26*b* and bearing 27 so as to swivel about the axis 50. The other end engages in the eye 5 of the armature via the bolt 26*a* and the bearing 25.

Figure 5:
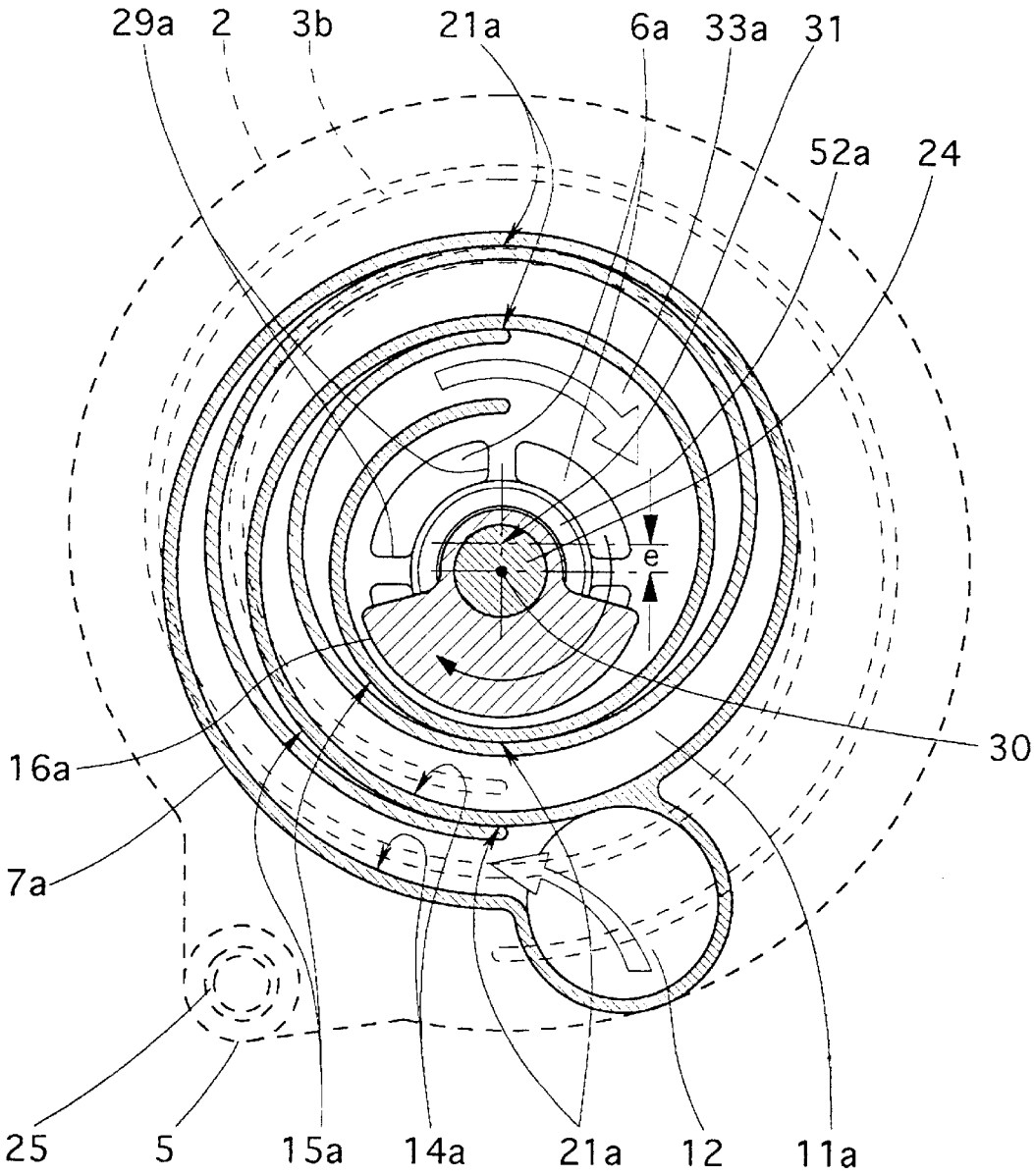
FIG. 5 shows a transverse section through the compression part of the displacement machine according to lines 5—5 and 5'—5' in FIG. 1.

According to FIGS. 1, 5 and 6, apertures 6*a* are provided at the spiral run-out on the compression side in housing half 7*a*, so that the feed medium can be drawn off through the central outlet 13 arranged at one side.

FIG. 1 shows the machine housing 7*a*, 7*b* made up of two halves connected to each other via securing brackets 8*a*, 8*b* for receiving screw fittings 8*c*. Reference number 11*a* designates the feed chamber on the compression side, which feed chamber is incorporated in the housing half 7*a* in the manner of a spiral slit. It runs parallel from a low-pressure inlet 12, arranged on the outer circumference of the spiral in housing half 7*a*, to a pressure chamber 33*a*, provided in the interior of the housing, and to the high-pressure outlet 13. The feed chamber 11*a* has one or more approximately parallel cylinder walls 51*a* which are arranged roughly at a constant distance from each other and which, in the present case, encompass a spiral like the strip 3*a* of the disk 2. The strip 3*a* engages between these cylinder walls 51*a*, the curvature of the strip 3*a* being dimensioned such that said strip 3*a* almost touches the inner cylinder wall 15*a* and the outer cylinder wall 14*a*, for example at in each case one point 21*a* (FIG. 5).

FIG. 2 shows an embodiment of the lateral sealing of the strip 3*a* relative to the bottom surfaces of the spiral slit incorporated in the housing half 7*a*. This is achieved, for example, by means of a contacting sealing tape 28 which is incorporated in a groove provided for this purpose in the strip 3.

The drive mechanism of the disk 2 powers the drive shaft 24 via the eccentric disk 23. The disk 2 is guided by the guiding device 49 (FIG. 4). Depending on whether the guiding device 49 is made up of an oscillating link 56 or of a guide shaft (not shown) running in synchronism with the drive shaft 24, all points on the strip 3*a* execute an elliptical or a circular displacement movement with an excursion corresponding to the eccentricity "e". The hub 4 cannot be seen in FIG. 4 since this part of the disk 2 is cut away here. The bearing 17, with which the disk 2 is guided on the eccentric disk 23, is represented here by way of example as a rolling bearing.

The multiple alternating approximation of the strip 3*a* to the inner cylinder wall 15*a* or outer cylinder wall 14*a* of the associated feed chamber 11*a* results, on both sides of the strip 3*a*, in the formation of sickle-shaped working chambers which enclose the working medium and which, during operation of the disk 2, are moved through the feed chamber 11*a* in the direction toward the pressure chamber 33*a* and the central outlet 13 communicating with the latter. The volumes of these working chambers decrease and the pressure of the working substance correspondingly increases.

Figure 3:
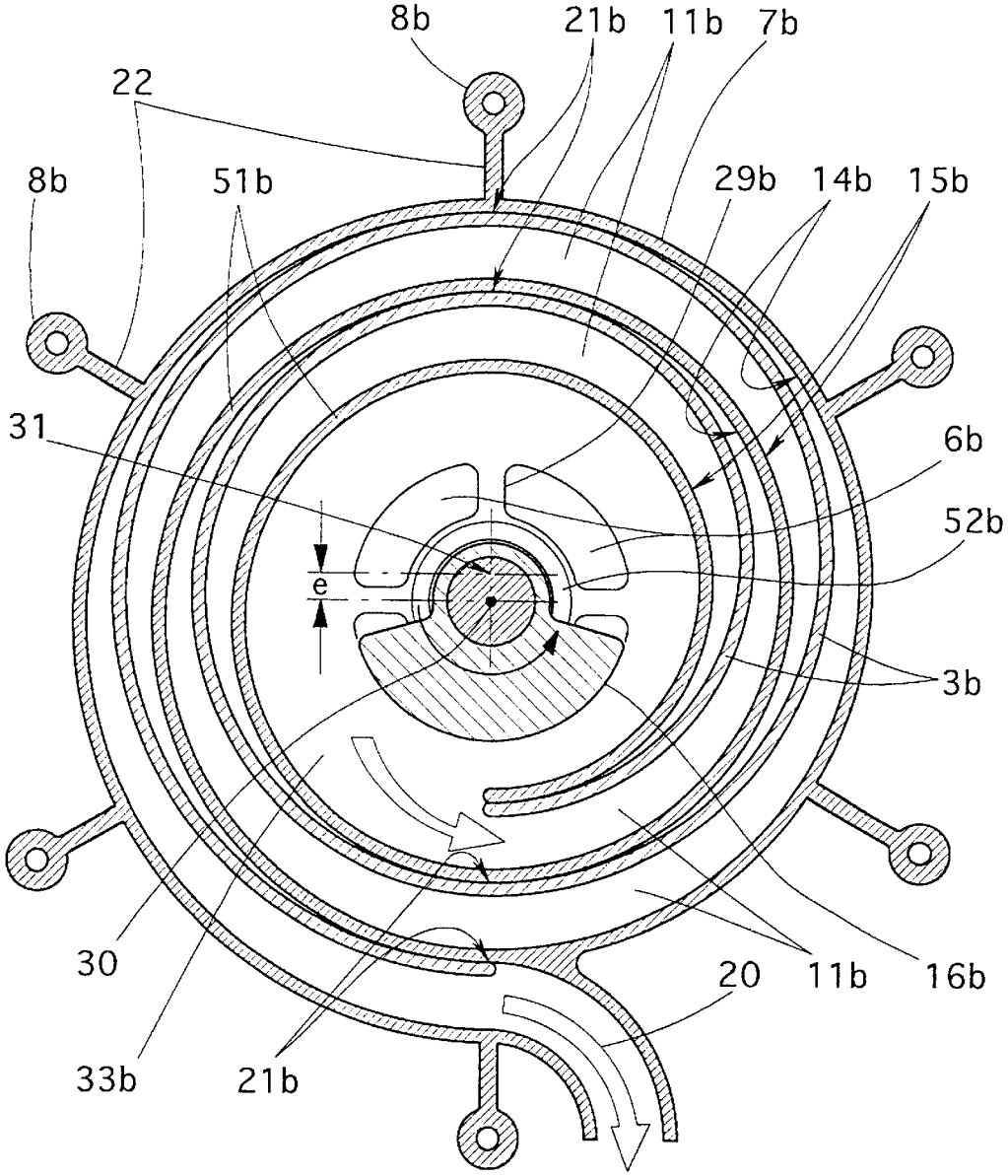
FIG. 3 shows a transverse section through the displacement machine according to 3—3 in FIG. 1, with the expansion part of the displacement machine.

The arrangement of the strip 3*b* on the expansion side of the machine is analogous to what has been described above. Reference number 11*b* designates the feed chamber on the expansion side, which feed chamber is likewise incorporated into the housing half 7*b* in the manner of a spiral slit. According to FIG. 3, it runs parallel from a low-pressure outlet 20, arranged on the outer circumference of the spiral in the housing, to an inlet which is provided in the interior of the housing and which forms part of the pressure chamber 33*b* in the housing 7*b*. The feed chamber 11*b* likewise has approximately parallel cylinder walls 51*b* which are arranged roughly at a constant distance from each other and which, in the present case, encompass a spiral like the strip 3*b* of the disk 2. The strip 3*b* engages between these cylinder wails 14*b*, 15*b*, the curvature of the strip 3*b* being dimensioned such that said strip 3*b* almost touches the inner cylinder wall 15*b* and the outer cylinder wall 14*b* during operation, for example at in each case one point 21*b*.

The strip 3*b* is arranged on the disk 2 in such a way that during machine operation, as a result of the multiple alternating approximation of the strip 3*b* to the inner cylinder wall 15*b* or outer cylinder wall 14*b* of the associated feed chamber 11*b*, sickle-shaped working chambers which enclose the working medium are formed on both sides of the strip 3*a*. During operation of the disk 2, these working chambers move through the feed chamber 11*b* in the direction toward the outlet 20. By this means, the volumes of these working chambers increase and the pressure of the working substance decreases in the expander part. As a result of the expansion of the working substance located in the working chambers on the expansion side, work is applied to the strip 3*b* and thus to the eccentric disk 23. Thus, the compression and expansion functions are combined in a single component rotating in a fixed housing 7*a*, 7*b* and made up of disk 2, hub 4 and strips 3*a* and 3*b*.

FIG. 5 shows the arrangement of the strips 3*a* and 3*b* arranged on both sides of the disk 2. In accordance with the illustrated orientation of the cutting direction 5—5 through FIG. 1, the direction of rotation of the drive shaft 24 with the counterweight 16*a* about the center of rotation 30 is in the clockwise direction. The outer edge of the disk 2 and the strip 3*b* of the expander part are indicated by broken lines in accordance with section 5'—5' in FIG. 1. For the sake of clarity, the spiral wall 51*b* in the housing half 7*b* is not shown. However, the arrangement of the strip 3*a* on the compression side relative to the strip 3*b* on the expansion side is clear.

In FIG. 1 the drive shaft is mounted with a journal bearing 9*a* in a bearing seat 52*a* in the housing half 7*a*. The bearing seat 52*a* is connected to the housing half via ribs 29*a*. The bearing is sealed off from the pressure chamber 33*a* by means of a shaft seal 33*a*. The apertures 6*a* are located between the ribs 29*a*. The feed medium brought to a higher pressure can leave the compressor part through these apertures. The feed medium can be delivered to a process which is not described here.

After this process, in which no particular drop in pressure is assumed to take place, the working substance is intended to flow via the high-pressure inlet 19 into the inner expansion-side pressure chamber 33*b* of the expander part. In housing half 7*b*, the drive shaft is guided by means of a journal bearing 9*b* which is supported on housing half 7*b* via a bearing seat 52*b* with the ribs 29*b*. Between the ribs are the apertures 6*b* which create the access of the working substance into the expansion-side pressure chamber 33*b*.

The disk 2 is guided on the eccentric disk 23 via the eccentric bearing 17 onto which the hub 4 is mounted and which is sealed off from the pressure chambers 33*a* and 33*b* for example with shaft seals 18. Reference number 31 designates the center of the eccentric disk 23. This center is spaced apart from the center of rotation 30 by an eccentricity "e" Counterweights 16*a* and 16*b* are arranged on the drive shaft 24 and ensure a balanced operation of the machine.

FIG. 6 shows an alternative embodiment of the compressor/expander machine with a drive motor, preferably an electric motor. The housing 66 of the motor has threaded brackets 8*b'* into which screw fittings 8*c* engage. Together with an intermediate housing 54 on the expansion side and the housing halves 7*a* and 7*b*, the compressor/expander machine 1 is connected to the electric motor to form one machine.

The working substance to be expanded must be guided, at the inlet side of the intermediate housing 54, in a way which takes account of the fact that the working substance in the expansion part of the compressor/expander machine flows from the inside outward, when viewed in the radial direction; it must be guided in toward the center of the expansion side of the displacement machine. The schematically illustrated solution shows that the working substance enters the intermediate housing 54 at the high-pressure inlet 55 and passes through apertures 99 into an annular chamber 32. On the side of the compressor/expander machine 1, this chamber 32 is sealed off from the surrounding pressure prevailing in the interior 63 of the electric motor housing by means of the shaft 24 with a journal bearing 58, and on the electric motor side it is sealed off by means of a shaft seal 62. The shaft seal 62 engages on a thickening 44 arranged on the drive shaft. The annular chamber 32 is connected to the pressure chamber 33*b* via apertures 57 in the shaft 24, so that the working substance to be expanded can pass into the interior 33*b* of the expander part.

The passage of the working substance through the apertures in the shaft 24 is expedient for the reason that the whole drive shaft with the rotor 64 of the electric motor is guided only with two journal bearings 58, 93. In addition, in contrast to the embodiment according to FIG. 1, only one counterweight 16 is to be arranged on the shaft 24, on the expansion side to be precise. To ensure the flexural strength of the drive shaft 24 needed for stable running of the machine, said drive shaft 24 is given a relatively large diameter in the area of the journal bearing 58. The arrangement of apertures 57 (see also FIGS. 7 and 8) in the rigid part is expedient for introduction of the working substance which is to be expanded.

In the example shown in FIG. 6, the journal bearing 58 is designed as a rolling bearing on whose outer ring a positioning ring 59 is attached, which lies in a depression incorporated for example in the housing half 7*b* and is clamped by the intermediate housing 54. On the drive shaft 24, the inner ring of the rolling bearing 58 bears on one side on a collar 82 and on the other side on a ring 83. By means of this arrangement, the drive shaft 24 is guided axially in relation to the housing parts 7*a*, 7*b*, 54 and 66.

On that side of the electric motor remote from the compressor/expander unit 1, said electric motor consisting essentially of the housing 66 and the rotor 64, there is a lubricant container 68 with the lubricant reservoir. A device which generates a stream of lubricant for lubricating and cooling the highly stressed eccentric bearing 17 is necessary because the compressor/expander machine is intended to be of small size in relation to the delivered stream of working substance and thus to be operated at high speed. This results in the aforementioned high stressing of the eccentric bearing 17. The lubricant circuit is as follows.

The container 68 surrounds a housing 71 which receives the journal bearing 93 of the shaft 24 facing away from the compressor/expander unit. Moreover., in the housing 71, a lubricant feed device 72 (not described here) is mounted on the drive shaft 24 and driven by the latter. This lubricant feed device 72 suctions the lubricant from the reservoir 69 via a suction line 79 and feeds it at high pressure into a chamber 73.

In the shaft 24 common to the rotor 64 and to the compressor/expander machine 1, an insert 75 is introduced into a central bore 76, which insert 75 for its part has a central feed bore 74. The latter is connected to the chamber 73 on the side of the lubricant reservoir. On the side of the compressor/expander unit 1, the feed bore 74' is connected to a bore 88 arranged radially in the eccentric disk 23. At its radially outer end, the bore 88 opens directly into the eccentric bearing 17 and supplies the latter with lubricant. In FIG. 6, this bearing is designed as a plain bearing; a plain bearing bush 17' is let into the hub 4.

The hub 4 is sealed off from the chamber 33*a* and the outlet 13 by means of a closure piece 60. This closure piece ensures complete separation of the lubricant from the working substance. The working substance can thus be fed completely free of lubricant. This is in contrast to the embodiment according to FIG. 1 in which the arrangement of the shaft seals 10*a* and 18 can lead, on the compression side, to lubricant escaping into the chamber 33*a*; shaft seals cannot ensure complete sealing.

Figure 7:
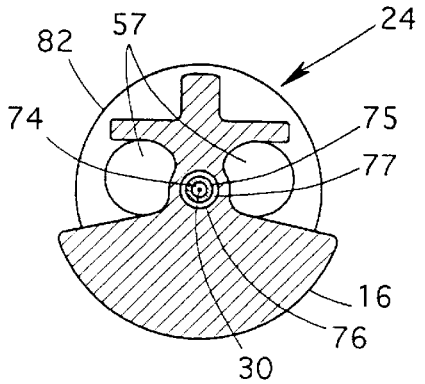
FIG. 7 shows a transverse section through the drive shaft along the line 7—7 in FIG. 6.

The lubricant can pass from the eccentric bearing 17 into the chamber 80 formed by the closure piece 60. The lubricant passes from the opposite side of the bearing 17 into an annular chamber 53*c* which is sealed off from the expansion-side pressure chamber 33*b* by means of a shaft seal ring 18. The lubricant collection chambers 53*c* and 80 are connected in each case via a bore 81 to the lubricant return channel 77 in the shaft 24. This channel is created by an insert 75 which in its central part is recessed on the outer circumference. In FIG. 7, the recessed portion of the insert 75 is shown in cross section (section 7—7 in FIG. 6) and this figure shows, in addition to the center of rotation 30 of the shaft 24, the feed bore 74, the annular lubricant return channel 77, and the central bore 76 for the insert 75. A radial bore 77*c* is incorporated in the shaft 24 on the side of the lubricant reservoir 69. The lubricant can pass through this bore into an annular collection chamber 45. The collection chamber 45 is incorporated in the housing 66 and is formed together with a shaft seal ring 78 and the feed pump housing of the lubricant feed device 72, and the shaft 24. Arranged in the housing 66 there is a bore 90 through which the returning lubricant can flow back into the reservoir 69.

The compression of the gaseous working substance (e.g. air) results in a temperature increase in the chamber 33*a* compared with the temperature prevailing in the low-pressure inlet 12. The higher temperature in the chamber 33*a* acts on the hub portion 4 with closure piece 60 rotating in this chamber. In addition to its primary role of lubricating the bearing 17, the lubricant also has the role of carrying off heat from the hub portion 4 with closure piece 60. As has been described above, the lubricant flowing back into the reservoir 69 must be able to give off its accumulated heat there, for example to the environment.

An embodiment for heat removal is likewise represented in FIG. 6. Corresponding to the prior art, electric motors often have a blower wheel 67 which, in the present example, is mounted on the shaft 24. Through apertures 65 in the housing 66, the cooling air stream 85 passes into the interior of the electric motor and, depending on the strength of the cooling air stream 85 generated by the blower wheel 67, experiences a greater or lesser increase in temperature. Assuming that the blower wheel is made powerful enough, this affords an advantageous embodiment for cooling the lubricant in the reservoir container 68. By diverting the cooling air stream via air guide means 84, this stream is conveyed past the cooling surfaces 70, which are arranged on the container 68, and takes up further heat from the container 68.

Figure 8:
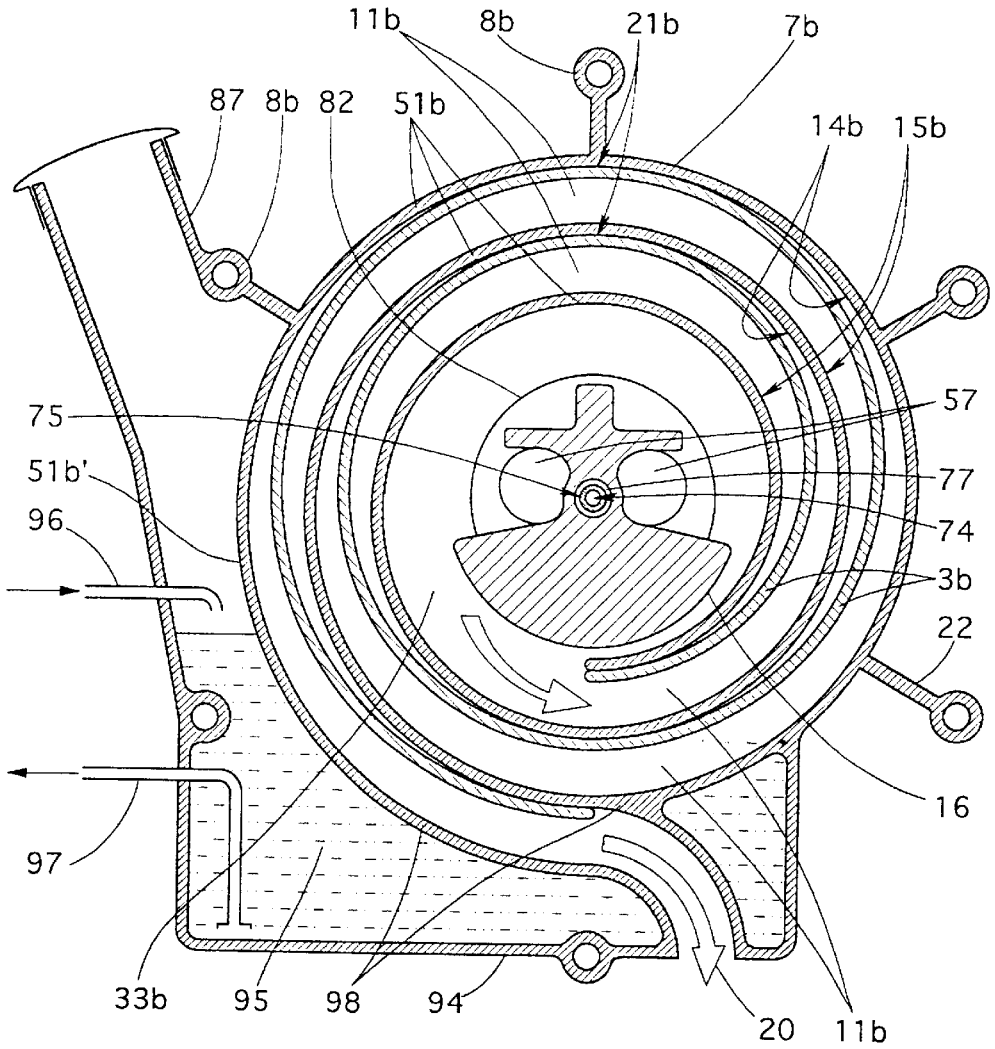
FIG. 8 shows a transverse section through the displacement machine according to line 8—8 in FIG. 6, with the expansion part of the displacement machine and a housing half designed as a lubricant and coolant reservoir.

An alternative embodiment for removing heat from the lubricant is represented in FIG. 8. The drawing shows diagrammatically a wall part 94 of the housing 7*b*, which wall part 94 is designed such that a container 95 is obtained. This container is located in the area of the outer end 98 of the cylinder wall 51*b*, when viewed in the flow direction. The lubricant is delivered to and removed from the container 95 via external lines 96, 97 (not described in detail) which can be connected to a lubricant feed device 72, as is represented in FIG. 6. This arrangement exploits the fact that the temperature decreases upon expansion of the gaseous working substance.

When the compressor/expander machine 1 is used, for example, on fuel cells, the temperature at the inlet of the working substance into the chamber 33*b* is relatively low, assuming that no special devices are used which increase the temperature of the working substance in the high-pressure inlet 19 or 55, 33*b* of the expansion machine. Such devices can consist, for example, of heat exchanger which give off the heat of the compressed air after the outlet 13 to the working substance to be expanded before the inlet 19 or 55, 33*b* and heat this in order to increase the expansion performance.

Since water is an essential oxidation product in fuel cell use, the working substance being enriched with water before the expansion process, it must be assumed that the temperature will drop considerably below the dew point toward the low-pressure outlet 20 and, depending on the starting temperature of the expansion, will also be below the freezing point. If no special measures are taken, ice is able to form in the area of the cylinder walls 98 during machine operation.

This is avoided by the fact that the part around the outlet 20, 98 is used to apply the lubricant reservoir 95 there. On the one hand, the latter is cooled by this measure, and, on the other hand, ice formation at 20, 98 is prevented.

Figure 9:
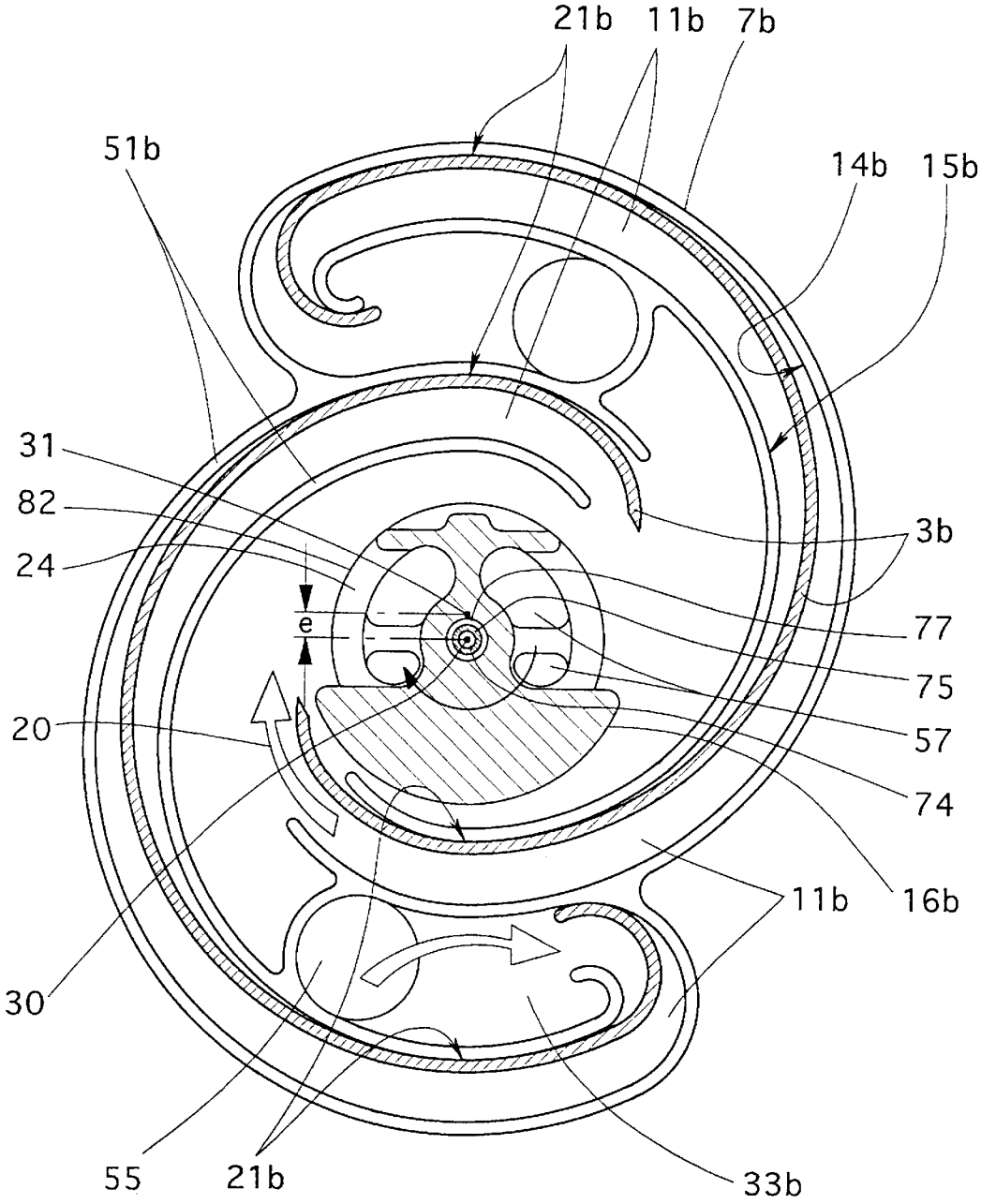
FIG. 9 shows the principle of an alternative embodiment in which the expansion is carried out from radially outside to radially inside.

FIG. 9 shows an illustrative embodiment in which the expansion of the working substance takes place from radially outside to radially inside. In contrast to the expansion shown in FIGS. 1, 3 and 6, the high-pressure gas flows through an opening 55 into the high-pressure chamber 33*b*. The expanded gas flows out of the low-pressure interior of the expander part through apertures 57 in the shaft 24.

Figure 10:
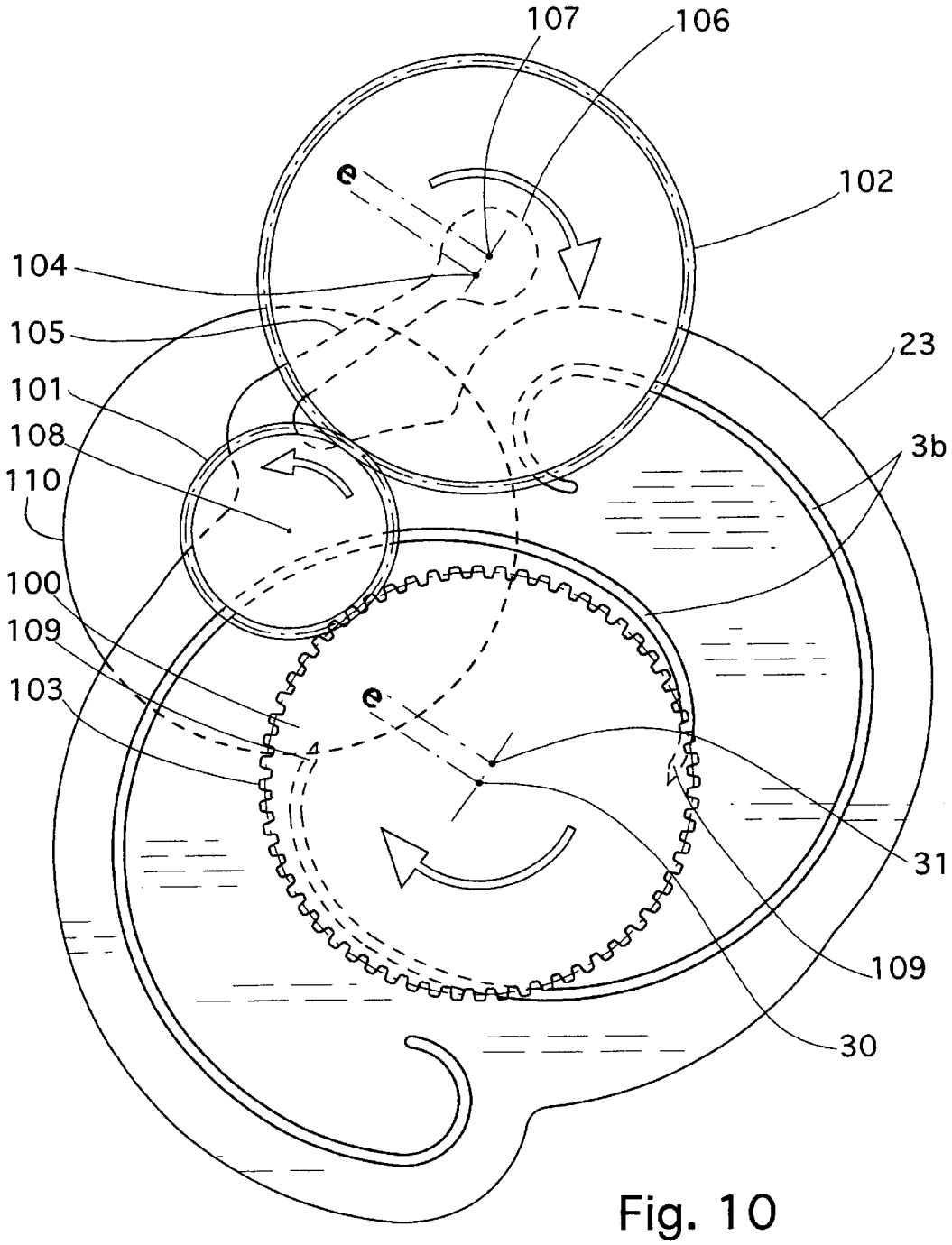
FIG. 10 shows the principle of an alternative embodiment according to FIG. 9, with double eccentric drive and synchronizing gearwheels.

The invention is of course not limited to the machine shown and described above. In the case where two separate eccentric arrangements are used for guiding the displacement body, the electric motor can engage, not on the drive shaft 24, but instead between two shafts with separate axes of rotation 30 and 104. Such an arrangement is shown in FIG. 10. For the sake of clarity, this shows only the displacement body consisting of the disk 23 and the strips 3*b* with the wheel gearing. The latter consists of a drive wheel 100, a wheel 101 on the drive motor 110, and a synchronizing wheel 102. Reference number 103 designates a toothing on the wheel. Identical toothing is also provided for the wheels 101 and 102 but is not shown here. The axis of the drive motor is indicated by 108, that of the eccentric guiding arrangement is indicated by 104. The central disk 23 has, for example, a known radially elastic and tangentially rigid attachment 105 to the eye 106. The eye 106 has its center point at 107 which, during machine operation, rotates round the center of rotation 104 with the eccentricity "e".

LIST OF REFERENCE NUMBERS

| | |
|---|---|
| 1 | compressor/expander |
| 2 | disk |
| 3a, 3b | strips, displacement bodies |
| 4 | hub |
| 5 | eye |
| 6a | aperture in 7a |
| 6b | aperture in 7b |
| 7a, 7b | housing half |
| 8a, 8b, 8b' | securing bracket |
| 8c | securing screw |
| 9a | journal bearing for 24 in 7a |
| 9b | journal bearing for 24 in 7b |
| 10a, 10b | shaft seals of 24 |
| 11a | feed chamber in 7a |
| 11b | teed chamber in 7b |
| 12 | low-pressure inlet |
| 13 | high-pressure outlet |
| 14a | outer cylinder wall of 11a |
| 14b | outer cylinder wall of 11b |
| 15a | inner cylinder wall of 11a |
| 15b | inner cylinder wall of 11b |
| 16, 16a, 16b | counterweights on 24 |
| 17, 17' | eccentric bearings between 4 and 23 |
| 18 | shaft seals of 23 |
| 19 | high-pressure inlet |
| 20 | low-pressure outlet |
| 21a, 21b | sealing line in 7a, 7b of 11a, 11b |
| 22 | rib |
| 23 | eccentric disk |
| 24 | drive shaft |
| 25 | guide bearing in 56 on 26a |
| 26a | guide bolt in 2 |
| 26b | guide bolt between 7a, 7b |
| 27 | guide bearing in 56 on 26b |
| 28 | sealing tape |

-continued

LIST OF REFERENCE NUMBERS

| | |
|---|---|
| 29a, 29b | rib |
| 30 | center of rotation of 24 |
| 31 | center of 23 |
| 32 | annular chamber between 58 and 62 |
| 33a | pressure chamber in 7a (compressor side) |
| 33b | pressure chamber in 7b (expander part) |
| 44 | collar for 62 on 24 |
| 45 | annular collection chamber |
| 49 | guiding device |
| 50 | center axis of 26b |
| 51a, 51b, 51b' | strips in 7a, 7b |
| 52a, 52b | bearing seat in 7a, 7b |
| 53a | bearing interior of 9a |
| 53b | bearing interior of 9b |
| 53c | bearing interior of 17 |
| 54 | intermediate housing |
| 55 | high-pressure inlet |
| 56 | oscillating link |
| 57 | aperture in 24 |
| 58 | bearing |
| 59 | clamping ring between 54 and 7b |
| 60 | closure disk on 4 |
| 61 | high-pressure intermediate chamber |
| 62 | shaft seal between 61 and 63 |
| 63 | interior of electric motor |
| 64 | rotor of electric motor |
| 65 | apertures in 66 |
| 66 | housing of the electric motor |
| 67 | blower wheel on 24 |
| 68 | housing of 69 |
| 69 | lubricant reservoir, lubricant |
| 70 | cooling surface |
| 71 | bearing housing |
| 72 | feed pump for 69 |
| 73 | pressure chamber of 69 |
| 74, 74' | pressure line for 69 in 24 |
| 75, 75' | insert in 24 |
| 76 | bore in 24 |
| 77, 77c | lubricant return channel in 24 |
| 78 | shaft seal 24, rear |
| 79 | suction line for 69 |
| 80 | low-pressure chamber between 60 & 23 |
| 81 | low-pressure lines in 23 to 77 |
| 82 | shoulder on 24 for 58 |
| 83 | positioning ring on 24 for 58 |
| 84 | guide means for 85 |
| 85 | cooling air stream |
| 86 | screw fitting for 68 |
| 87 | filler attachment for 69 with lid |
| 88 | connection between 74 & 17 in 23 |
| 89 | screw fitting of 71 to 66 |
| 90 | low-pressure outlet in 66 to 69 |
| 93 | bearing of 24 in 71 |
| 94 | outer wall of 95 |
| 95 | lubricant chamber |
| 96 | lubricant return flow |
| 97 | lubricant feed |
| 98 | end portion of 51b |
| 99 | aperture in 54 |
| e | eccentricity; radial spacing between the axis of rotation 30 of 24 and the center 31 of 23 |
| 100 | drive wheel on drive shaft 24 |
| 101 | drive wheel on drive motor |
| 102 | synchronizing wheel on second eccentric arrangement |
| 103 | toothing |
| 104 | center of rotation of the second eccentric arrangement |
| 105 | radially elastic, tangentially rigid attachment to 23 |
| 106 | eye on 105 |
| 107 | center of the second eccentric arrangement |

-continued

| LIST OF REFERENCE NUMBERS | |
|---|---|
| 108 | center of rotation of the laterally built-on drive motor |
| 109 | inner end of 3b in FIG. 10 |

What is claimed is:

1. A displacement machine for compressible media with two spiral feed chambers which are arranged opposite each other in a fixed housing, and with spiral displacement bodies engaging in these feed chambers, consisting essentially of a central disk and of spiral strips which are attached to each side of the disk and which are held in an eccentric manner in relation to the housing, so that during operation each point on the displacement body executes a circular or elliptical movement, depending on a configuration of a guiding device, said movement being limited by cylinder walls of the feed chamber, and so that a curvature of the strips is dimensioned such that it almost touches inner cylinder walls and outer cylinder walls of the feed chamber on in each case at least one sealing line per strip, said sealing line advancing continuously during operation, and, in order to guide the displacement body in relation to the housing, an eccentric arrangement is provided which essentially consists of a drive shaft and of an eccentric disk arranged thereon, characterized in that one feed chamber is configured for compressing a working substance and the other opposite feed chamber for expanding said working substance, the feed chambers each have an inlet and an outlet, the inlet of any one feed chamber is separate from the outlet of the other opposite feed chamber, the feed chambers and the strips engaging in them consisting essentially of successive circular arc segments, radii of the circular arc segments in the compression-side feed chambers and strips essentially decreasing in size, when viewed in a direction of rotation, and radii of the circular arc segments in the expansion-side feed chambers and strips essentially increasing in size, when viewed in the same direction of rotation.

2. The displacement machine as claimed in claim 1, characterized in that the expansion-side half (7*b*) of the housing is connected directly to a housing (66) of an electric motor via a screw fitting (8*a*, 8*b*, 8*b*', 8*c*).

3. The displacement machine as claimed in claim 1, characterized in that the compression-side feed chamber (11*a*) extends from a radially outward low-pressure inlet (12) to a radially inward high-pressure outlet (13), and in that the expansion-side feed chamber (11*b*) extends from a radially inward high-pressure chamber (33*b*) to a radially outward low-pressure outlet (20).

4. The displacement machine as claimed in claim 3, characterized in that the hub (4) of the disk (2) is surrounded on its outside on the compression side by a high-pressure chamber (33*a*), in that the hub interior is closed off in an airtight manner from this high-pressure chamber (33*a*) by means of a closure piece (60), and in that a counterweight (16)—provided to compensate the eccentric movement of the eccentric disk (23) and of the displacement body (2–4)—is arranged on the drive shaft (24) in the expansion-side pressure chamber (33*b*) surrounding the hub (4).

5. The displacement machine as claimed in claim 3, characterized in that the expansion-side half (7*b*) of the housing is connected to a housing (66) of an electric motor by means of an intermediate housing (54), said intermediate housing having an outer high-pressure inlet (55) for the working substance to be expanded, and apertures (99) in the intermediate housing (54) and apertures (57) in the drive shaft (24) connect the inlet (55) to the high-pressure chamber (33*b*).

6. The displacement machine as claimed in claim 3, characterized in that the wall (94) of the expansion-side half (7*b*) of the housing is configured in the area of the outlet (20) in such a way that a container (95) for receiving lubricant is formed together with the outer end (98) of the cylinder wall (51*b*') of the expansion-side feed chamber (11*b*), said container being connected to the lubricant circuit via external lines (96, 97).

7. The displacement machine as claimed in claim 1, characterized in that a rotor (64) of an electric motor is arranged on a common drive shaft (24) with the eccentric disk (23) and the displacement body (2–4).

8. The displacement machine as claimed in claim 7, characterized in that, on the side of the electric motor facing away from the displacement body (2–4), an intermediate housing (71) is attached to the housing (66) of the electric motor, into which intermediate housing protrudes the drive shaft provided with a lubricant feed device (72), and in that a housing (68) for a lubricant reservoir (69) is secured on the intermediate housing (71).

9. The displacement machine as claimed in claim 8, characterized in that a blower wheel (67) for feeding a cooling air stream (85) is arranged on the drive shaft (24) inside the housing (66) of the electric motor, this cooling air stream being directed via apertures (65) in the housing (66) through the interior (63) of the electric motor and via air guide means (84) onto cooling surfaces (70) which are arranged on the housing (68) of the lubricant reservoir (69).

10. The displacement machine as claimed in claim 8, characterized in that the drive shaft (24) has a bore (76) for receiving an insert (75) which is likewise of hollow configuration and which in the central area is recessed on the outer surface, resulting in two axial lubricant guide channels (74, 77) about the center of rotation (30) of the drive shaft (24), of which a high-pressure channel (74) is connected on the one hand to the lubricant feed device (72) via a pressure chamber (73) and is connected on the other hand to an eccentric bearing (17) via a chamber (74') and a bore (75') in the eccentric disk (23).

11. The displacement machine as claimed in claim 10, characterized in that, for return of the lubricant from the eccentric bearing (17) into the lubricant reservoir (68), a low-pressure chamber (80) and a bearing interior (53*c*) are provided on either side of the bearing and these are in each case connected via a bore (81) in the eccentric disk (23) to the lubricant return channel (77) arranged in the drive shaft (24).

12. A displacement machine for compressible media with two spiral feed chambers which are arranged opposite each other in a fixed housing, and with spiral displacement bodies engaging in these feed chambers, consisting essentially of a central disk and of spiral strips which are attached to each side of the disk and which are held in an eccentric manner in relation to the housing, so that during operation each point on the displacement body executes a circular or elliptical movement, depending on a configuration of a guiding device, said movement being limited by cylinder walls of the feed chamber, and so that a curvature of the strips is dimensioned such that it almost touches inner cylinder walls and outer cylinder walls of the feed chamber on in each case at least one sealing line per strip, said sealing line advancing continuously during operation, and, in order to guide the displacement body in relation to the housing, an eccentric arrangement is provided which essentially consists of a drive shaft and of an eccentric disk arranged thereon, characterized in that one feed chamber is configured for compressing a working substance and the other opposite feed chamber for expanding said working substance, the feed chambers and the strips engaging in them consisting essentially of successive circular arc segments, radii of the circular arc segments in the compression-side feed chambers and strips essentially decreasing in size, when viewed in a direction of rotation, radii of the circular arc segments in the expansion-side feed chambers and strips essentially increasing in size, when viewed in the same direction of rotation, the compression-side feed chamber extends from a radially outward low-pressure inlet to a radially inward high-pressure outlet, and in that the expansion-side feed chamber extends from a radially outward high-pressure inlet to a radially inward low-pressure chamber.

13. The displacement machine as claimed in claim 12, in which the displacement body is guided by a separate second eccentric arrangement, characterized in that the two eccentric shafts bear gearwheels of identical size which are driven and synchronized by a third gearwheel, said third gearwheel being arranged on a shaft of a drive motor, and the drive motor being designed as a rapidly rotating electric motor.

14. The displacement machine as claimed in claim 12, characterized in that a hub of the disk is surrounded on its outside on the compression side by a high-pressure chamber, in that the hub interior is closed off in an airtight manner from this high-pressure chamber by means of a closure piece, and in that a counterweight—provided to compensate an eccentric movement of the eccentric disk and of the displacement body—is arranged on the drive shaft) in the expansion-side pressure chamber surrounding the hub.

* * * * *